US012054899B2

(12) United States Patent
Wieczorek

(10) Patent No.: US 12,054,899 B2
(45) Date of Patent: Aug. 6, 2024

(54) WIRE ROPE SAFETY BARRIER

(71) Applicant: FLETCHER BUILDING HOLDINGS LIMITED, Auckland (NZ)

(72) Inventor: Wojciech Wieczorek, Auckland (NZ)

(73) Assignee: FLETCHER BUILDING HOLDING LIMITED, Auckland (NZ)

( * ) Notice: Subject to any disclaimer, the term of this patent is extended or adjusted under 35 U.S.C. 154(b) by 843 days.

(21) Appl. No.: 17/253,219

(22) PCT Filed: Dec. 19, 2019

(86) PCT No.: PCT/IB2019/061062
§ 371 (c)(1),
(2) Date: Dec. 17, 2020

(87) PCT Pub. No.: WO2020/128929
PCT Pub. Date: Jun. 25, 2020

(65) Prior Publication Data

US 2021/0310206 A1 Oct. 7, 2021

(30) Foreign Application Priority Data

Dec. 21, 2018 (NZ) ..... 749587

(51) Int. Cl.
*E01F 15/06* (2006.01)
*E01F 15/04* (2006.01)

(52) U.S. Cl.
CPC ..... *E01F 15/06* (2013.01); *E01F 15/0461* (2013.01)

(58) Field of Classification Search
CPC ..... E04F 15/06; E04F 15/065; E04H 17/02; E04H 17/06; E04H 17/10; E04H 17/12; E04H 17/124
USPC ..... 256/13.1, 47, 48, 52, 53, 54, 56, DIG. 3
See application file for complete search history.

(56) References Cited

U.S. PATENT DOCUMENTS

| | | | | |
|---|---|---|---|---|
| 1,801,890 A | | 4/1931 | Ward | |
| 2,321,988 A | | 6/1946 | Brickman | |
| 5,039,066 A | * | 8/1991 | Stacey | E01F 15/06 256/13.1 |
| 5,085,409 A | * | 2/1992 | Teixeira | E04H 17/12 256/48 |

(Continued)

FOREIGN PATENT DOCUMENTS

| | | | | |
|---|---|---|---|---|
| FR | 2516144 A1 | * | 5/1983 | E04H 17/10 |
| GB | 2033447 | | 5/1980 | |

(Continued)

OTHER PUBLICATIONS

International Search Report.

*Primary Examiner* — Josh Skroupa
(74) *Attorney, Agent, or Firm* — Jacobson Holman PLLC

(57) ABSTRACT

A wire rope safety barrier comprising a plurality of line posts positioned along a roadway. A plurality of cables are attached to the line posts and extend between the line posts to define a safety barrier along the roadway. At least one of the plurality of cables is an external cable engaging an outer surface of the line posts. Each external cable is connected to the line posts by a cable holder inserted through the cable holder slot, and the cable holder has a body portion and a hook portion. Each cable holder has a locating notch at a bottom surface configured to engage with the lower edge of a corresponding cable holder slot.

32 Claims, 9 Drawing Sheets

(56) References Cited

U.S. PATENT DOCUMENTS

| | | | | |
|---|---|---|---|---|
| 5,775,675 | A | 7/1998 | Sicking et al. | |
| 6,065,738 | A * | 5/2000 | Pearce | E01F 15/0476 256/13.1 |
| 6,729,607 | B2 * | 5/2004 | Alberson | E01F 15/0461 256/13.1 |
| 7,367,549 | B2 * | 5/2008 | Titmus | E01F 15/06 256/13.1 |
| 7,401,996 | B2 * | 7/2008 | Neusch | E01F 15/06 256/13.1 |
| 8,246,013 | B2 * | 8/2012 | Mauer | E01F 15/06 256/48 |
| 9,121,149 | B2 * | 9/2015 | Sharp | E01F 15/06 |
| 9,234,324 | B2 * | 1/2016 | Tonks | E01F 15/06 |
| 9,297,130 | B2 * | 3/2016 | James | E01F 15/06 |
| 10,106,939 | B2 * | 10/2018 | Neusch | E01F 15/00 |
| 10,253,469 | B2 * | 4/2019 | Brackin | E01F 15/06 |
| 10,385,529 | B2 * | 8/2019 | James | E01F 15/06 |
| 11,091,890 | B2 * | 8/2021 | Bergendahl | E01F 15/06 |
| 11,591,760 | B2 * | 2/2023 | Allington | E01F 15/06 |
| 11,773,548 | B2 * | 10/2023 | Faulkenberry | E04H 17/124 256/13.1 |
| 2002/0014620 | A1 * | 2/2002 | Nilsson | E01F 15/06 256/59 |
| 2007/0007501 | A1 | 1/2007 | Neusch | |
| 2016/0130775 | A1 | 5/2016 | Brackin et al. | |

FOREIGN PATENT DOCUMENTS

| | | | | |
|---|---|---|---|---|
| GB | 2166172 A * | 4/1986 | | E04H 17/12 |
| NZ | 527395 | 5/2006 | | |
| RU | 160941 | 4/2016 | | |
| WO | 2016/085183 | 8/2006 | | |
| WO | 2014/077701 | 5/2014 | | |
| WO | 2017/126979 | 7/2017 | | |

* cited by examiner

WIRE ROPE SAFETY BARRIER

FIELD OF THE INVENTION

The present invention relates to road safety barriers. More particularly, but not exclusively, it relates to wire rope safety barriers.

BACKGROUND OF THE INVENTION

Road safety barriers have been widely adopted to help keep people on the roads safe. Effective road safety barrier systems can help reduce the number of fatalities or injuries due to crashes, or the severity of the crashes.

Road safety barriers are often installed along roadways, especially highways, to divide vehicles travelling in opposite directions. These barriers can help prevent accidents across the median into oncoming traffic. Barriers may also be installed along the side of a road to keep vehicles on the road and from crashing into obstacles such as poles, trees, buildings, or from drivers from driving into a ditch or down other steep slopes.

Different types of road safety barriers may be suitable for different conditions. For example, road safety barriers may be rigid concrete walls, semi-rigid metal guardrails or flexible wire rope systems.

Wire rope barriers are flexible systems which provide a number of advantageous over more rigid systems due to its inherent ability to dissipate impact energy when a vehicle crashes into the barrier. As a result, impact forces experienced by occupants in a vehicle and exerted by on the vehicle itself are generally lower than that of rigid systems. Wire rope barriers can operate by absorbing impact energy to slow the vehicle down and redirecting it.

The profile of wire rope barriers may also be advantageous over other road barrier systems like concrete walls and guardrails. For example, wire rope safety barriers are relatively narrow and therefore may take up less space on the road. Wire rope safety barriers can accommodate straight roads well as well as roads with gentle bends as wire and post locations can be adjusted as required. Furthermore, wire rope barriers may be regarded as generally more aesthetically pleasing as they appear to be relatively discrete on a road landscape.

In many countries, road safety barriers like wire rope safety barriers are extensively tested to ensure that the road safety barrier meets certain standards or guidelines as required. Road safety barriers may need to be able to withstand the impact of vehicles of a certain mass, speed, angle and/or crash energy. Furthermore, often road safety barriers may need to be able to perform at a certain standard, having regard to different crash profiles. Road safety barriers should be able to perform at certain standards when a vehicle impacts at different locations in the system, such as when a vehicle impacts the wire rope directly, the post or at terminal ends.

Traditional road barriers such as concrete wall barriers may take a long time to set-up or restore after impact. It is generally desirable for the installation process of road safety barriers to be simple or quick. Reducing set-up or maintenance time would be beneficial as lane or road closures are inconvenient to road-users, and can lead to a more expensive operation due to greater labour costs.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purpose of this specification, where method steps are described in sequence, the sequence does not necessarily mean that the steps are to be chronologically ordered in that sequence, unless there is no other logical manner of interpreting the sequence.

It is an object of the present invention to provide a wire rope safety barrier which overcomes or at least partially ameliorates some of the abovementioned disadvantages or which at least provides the public with a useful choice.

BRIEF DESCRIPTION OF THE INVENTION

According to a first aspect the invention broadly comprises a plurality of line posts positioned along a roadway,

- each line post having at least one cable holder slot located on a side surface of the line post, the cable holder slot having an upper edge and a lower edge,
- a plurality of cables attached to said line posts and extending between said line posts to define a safety barrier along said roadway,
- at least one of said plurality of cables being an external cable engaging an outer surface of said line posts, and
- each external cable being connected to said line posts by a cable holder inserted through said cable holder slot, said cable holder having a body portion and a hook portion, and
- wherein each cable holder comprises a locating notch at a bottom surface configured to engage with the lower edge of a corresponding cable holder slot.

According to another aspect said body portion of the cable holder is located within the line post and said hook portion protrudes externally through the cable holder slot and supports said external cable.

According to another aspect said body portion of the cable holder is located within the line post and said hook portion protrudes externally through the cable holder slot and supports said external cable.

According to another aspect said hook portion forms:

- a cable receiving region and
- a constricted exit passage configured to allow a cable to enter and exit the cable receiving region once a first threshold force is applied to the cable.

According to another aspect said hook portion comprises a constriction portion which forms the constricted exit passage.

According to another aspect said constricted exit passage has a width substantially the same as the cable diameter.

According to another aspect said constricted exit passage has a width smaller than the cable diameter.

According to another aspect the engaging notch on the body portion is configured to engage with the upper edge of a cable holder slot to resist upward movement of the cable holder as the cable pulls the cable holder upwardly upon impact.

According to another aspect the cables are located at different heights above ground to provide different points of contact with a vehicle.

According to another aspect each cable holder comprises a ramp on the body portion configured to guide the cable holder into the line post when the cable holder is lifted upwards upon impact.

According to another aspect the ramp is located between a top end of the body portion and the cable receiving region and the ramp slopes downwardly and outwardly towards the hook portion.

According to another aspect the width of the constricted exit passage reduces as the cable holder is lifted upwardly and into the line post upon impact as the ramp bears upon the upper slot edge.

According to another aspect the cable can only exit the cable receiving region when a second threshold force is applied, wherein the second threshold force is greater than the first threshold force due to the reduction of width of the constricted exit passage.

According to another aspect the cable holder plastically deforms at least in said hook portion as the cable exits the cable receiving region.

According to another aspect the body portion is generally elongate and an inner surface of the line post engages with the body of the cable holder which is located within the line post to resist lateral movement upon impact.

According to another aspect said locating notch comprises a substantially vertically extending notch.

According to another aspect said locating notch widens towards a lowered surface of the cable holder to improve ease of assembly.

According to another aspect said body portion includes a tail region with a height which is approximately 10% to 30% the height of the body portion.

According to another aspect said tail region is approximately 15% to 25% the height of the body portion.

According to another aspect the hook portion of the cable holder comprises a region of weakness configured to allow a segment of the hook portion to deform and release the cable when a lateral force exerted by the cable is greater than a predetermined threshold.

According to another aspect the region of weakness is a reduction of the cross-sectional area in the hook portion.

According to another aspect the region of weakness comprises a cross-sectional area being approximately 40% to 80% the cross-sectional area of the rest of the hook portion.

According to another aspect the region of weakness is a notch on one or more outer hook surfaces.

According to another aspect the region of weakness is a notch on the inner hook surface adjacent a cable receiving region.

According to another aspect the region of weakness is located at a lower segment of the hook portion.

According to another aspect the region of weakness is located at a side segment of the hook portion.

According to another aspect each line post further comprises a cable slot extending from an upper surface configured to receive one or more internal cables.

According to another aspect the barrier has one to four external cables and zero to four internal cables.

According to another aspect three of said plurality of cables are external cables.

According to another aspect two of the three external cables engage a first outer surface of said line posts and one of external cable engages a second opposing outer surface of said line posts.

According to another aspect the wire rope safety barrier comprises four cables wherein one cable is located in a cable slot and three cables are external cables.

According to another aspect said cable holder slot has a height less than the height of the body portion of the cable holder.

According to another aspect said cable holder slot has a height between 20 mm and 40 mm.

According to another aspect said cable holder slot has a width between 5 mm and 10 mm.

According to another aspect said cable holder comprises a lower locating protrusion at the lower surface of the cable holder configured to engage the lower edge of the cable holder slot to prevent the cable holder from falling inside the line post.

According to another aspect the cable holder comprises a barb feature to retain the cable in the cable receiving region.

According to another aspect the barb feature forms the constricted exit passage.

According to another aspect the barb feature projects inwardly and downwardly towards the cable receiving region.

According to another aspect the barb feature forms a catching region on an underside of the barb feature to catch and retain the cable.

According to another aspect an end surface of the cable holder is angled inwardly and downwardly towards the cable receiving region to improve ease of cable installation.

According to another aspect the invention broadly comprises a method of installing a plurality of line posts spaced apart along a roadway, each line post comprising a cable holder slot including an upper edge and a lower edge, inserting a cable holder into each cable holder slot, said cable holder having a body portion and a hook portion, and connecting at least one cable to said line posts by positioning a cable into a cable receiving region of the cable holders such that the cables extend between line posts to define a safety barrier along said roadway, and wherein each cable holder comprises a locating notch at a bottom surface configured to engage with the lower edge of a corresponding cable holder slot.

According to another aspect the cable holder is obliquely inserted into the cable holder slot by first inserting an upper region of said body portion into said cable holder slot.

According to another aspect the invention broadly comprises a method of installing a wire rope safety barrier as claimed in the previous claim wherein after the cable holder is inserted into the cable holder slot, a lower locating protrusion at the lower surface of the cable holder engages the lower edge of the cable holder slot to prevent the cable holder from falling inside the line post.

According to another aspect the cable holder is lowered onto the lower edge of the cable holder slot after a tail region of said body portion is inserted within the line post.

According to another aspect the body portion is generally elongate and an inner surface of the line post engages with the body of the cable holder which is located within the line post to resist lateral movement upon impact.

According to another aspect a cable enters or exits the cable receiving region once a first threshold force is applied to the cable to move the cable past a constricted exit passage formed by a constricting portion.

According to another aspect an engaging notch at a top surface of the body portion engages with the upper edge of a cable holder slot to resist upward movement of the cable holder as the cable pulls the cable holder upwardly upon impact.

According to another aspect the cable holder is lifted upwards upon impact and the locating notch disengages from the lower edge of the cable holder slot.

According to another aspect the cable holder rocks backwards into the line post after the locating notch disengages from the cable holder slot as a ramp at a top surface of the body portion guides the cable holder inwards as the cable holder moves upwards.

According to another aspect the width of the constricted exit passage reduces as the cable holder is lifted upwardly and into the line post upon impact as the ramp bears upon the upper slot edge.

According to another aspect the cable can only exit the cable receiving region when a second threshold force is applied, wherein the second threshold force is greater than the first threshold force due to the reduction of width of the constricted exit passage.

According to another aspect the cable holder plastically deforms at least in said hook portion as the cable exits the cable receiving region.

According to another aspect a segment of the hook portion deforms at a region of weakness in the cable holder and releases the cable when a lateral force exerted by the cable is greater than a predetermined threshold.

According to another aspect an internal cable is inserted into a cable slot extending from an upper surface of the line post.

According to another aspect the invention broadly comprises a plurality of line posts positioned along a roadway, a plurality of cables attached to said line posts and extending between said line posts to define a safety barrier along said roadway, and a terminal end comprising:

a trigger post, a deflection post, a strut connector connecting the trigger post and the deflection post, and the plurality of cables extending between the trigger post and the deflection post, and wherein upon impact of a vehicle with said terminal end, the force exerted on said trigger post is transferred to the deflection post by the struct connector.

According to another aspect said trigger post is pivotable between an upright position and a collapsed position upon impact.

According to another aspect said deflection post moves towards a collapsed position as the trigger post transfers force to the deflection post upon impact.

According to another aspect the cables are held in tension when the deflection post is in an upright position, and the cables release tension as the deflection post moves towards the collapsed position upon impact.

According to another aspect the deflection post rotates about a connection point upon impact.

According to another aspect the deflection post is positioned between the trigger post and the plurality of line posts.

According to another aspect a trigger post connection between a first end of the struct connector and a connection region on the trigger post between a top and base region of the trigger post, and a deflection post connection between a second end of the struct connector and a connection region on the deflection post between a top and base region of the deflection post.

According to another aspect the deflection post connection is at a height approximately midway between the top and base region of the deflection post.

According to another aspect the deflection post deforms upon impact near the connection region on the deflection post and absorbs some energy from the impact.

According to another aspect the struct connector is substantially horizontal as the trigger post connection and deflection post connection is approximately at the same height above a ground surface.

According to another aspect the cables follow a first cable path between an anchor and a line post when the deflection post is in an upright position, and the cables follow a second cable path between the anchor and the line post when the deflection post moves towards a collapsed position, and wherein the distance of the second cable path is less than the first cable path.

According to another aspect the struct connector is located between 250 mm and 500 mm above a ground surface of the roadway.

According to another aspect the struct connector is located between 350 mm and 450 mm above a ground surface of the roadway.

According to another aspect a topmost cable of the plurality of cables is connected to the line posts 600 mm to 1200 mm above a ground surface of the roadway.

According to another aspect a topmost cable of the plurality of cables is connected to the line posts 800 mm to 1000 mm above a ground surface of the roadway.

According to another aspect a lowermost cable of the plurality of cables is connected to the line posts 400 mm to 650 mm above a ground surface of the roadway.

According to another aspect a lowermost cable of the plurality of cables is at a different angle to the other cables.

According to another aspect the lowermost cable of the plurality of cables is inclined downwards from a first line post towards the deflection post.

According to another aspect an anchor at the terminal end to receive and secure the plurality of cables.

According to another aspect the cables progressively incline downwards from the line posts towards the terminal end.

According to another aspect one or more transition posts between the terminal end and the plurality of line posts wherein the heights of the transition posts gradually reduces from the line posts toward the terminal end.

According to another aspect the strut connector comprises a slot extending from one end in a longitudinal direction to allow one or more cables to pass through.

According to another aspect the trigger post comprises a slot extending in a longitudinal direction to allow one or more cables to pass through.

According to another aspect the deflection post comprises a slot extending from an upper region in a longitudinal direction to allow one or more cables to pass through.

According to another aspect the deflection post comprises a region of weakness configured to allow the deflection post to deform or break at a predetermined fail line when a force applied to the deflection post is greater than a predetermined threshold upon impact.

According to another aspect the region of weakness is a horizontal groove extending at least partially across the deflection post.

According to another aspect the strut connector is a generally rectangular member.

According to another aspect top edges of the trigger post are rounded.

According to another aspect top edges of the deflection post are rounded.

Other aspects of the invention may become apparent from the following description which is given by way of example only and with reference to the accompanying drawings.

As used herein the term “and/or” means “and” or “or”, or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

BRIEF DESCRIPTION OF THE DRAWINGS

The invention will now be described by way of example only and with reference to the drawings in which.

DETAILED DESCRIPTION OF PREFERRED EMBODIMENTS

According to various aspects of the various embodiments of the present invention as illustrated in FIGS. 1 to 11B, there is provided a wire rope safety barrier 1 which will now be described.

General Features

Figure 1:
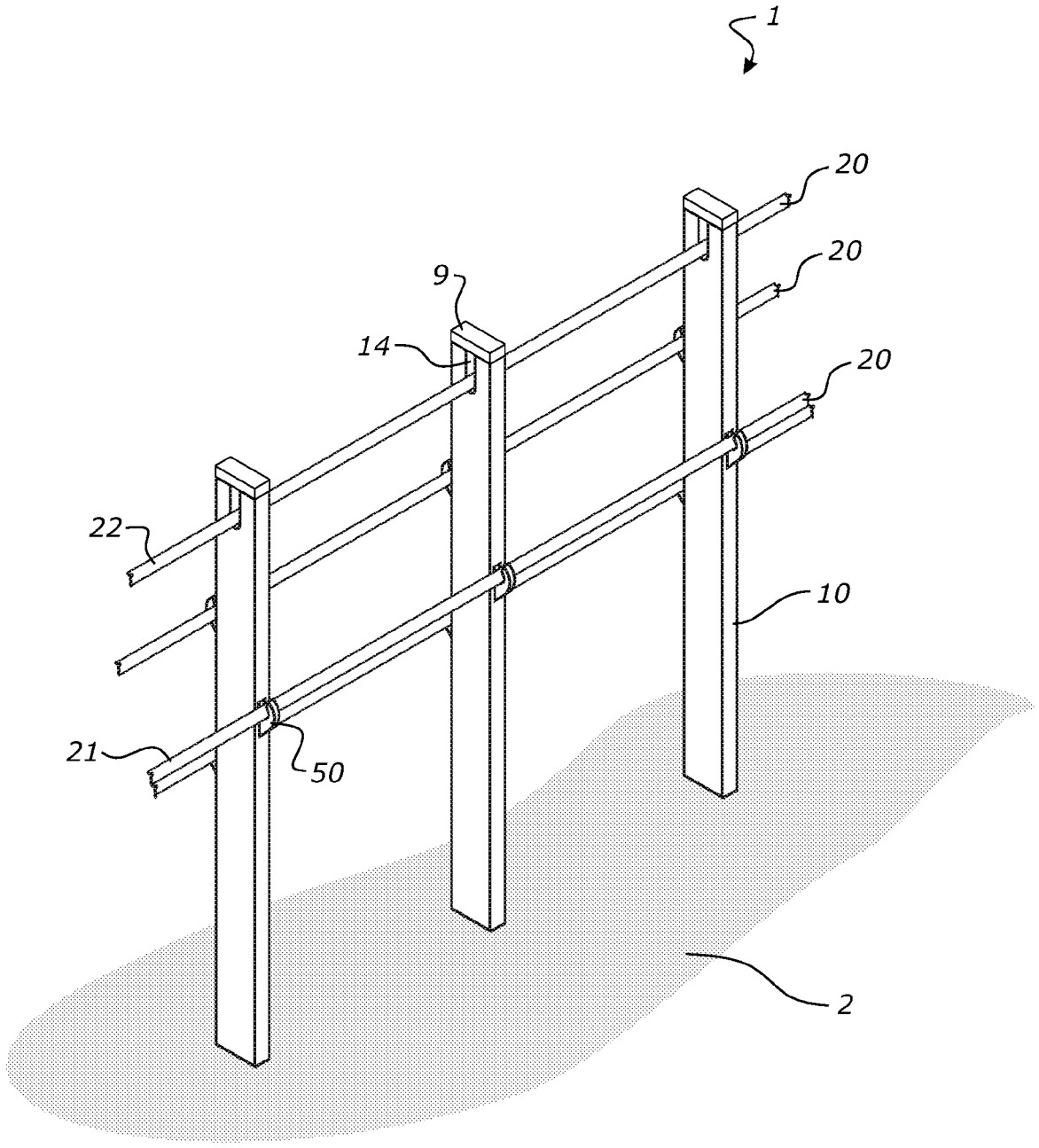
FIG. 1 shows a perspective view of line posts in a wire rope safety barrier system.

As referenced in FIG. 1, the wire rope safety barrier 1 comprises a plurality of line posts 10 positioned along a roadway. Preferably, to install the wire rope safety barrier 1, a plurality of line posts 10 are installed spaced apart along a roadway.

Preferably, the line posts 10 are spaced substantially evenly apart so that the distance between each post is approximately the same.

The spacing between line posts 10 may be adjusted to achieve desired deflection characteristics upon impact of a vehicle.

In some configurations, the plurality of line posts 10 are installed into the ground 2. Preferably, the line posts 10 are installed using methods known in the art. The line posts 10 may be installed using post foundation to hold the pots in the ground. Preferably, the line posts 10 are installed so that it has sufficient strength to resist an impact from a vehicle.

In the preferred configurations, the line posts 10 are between 1000 and 1800 mm tall. Preferably, a lower section of the line post 10 is installed below the surface of the ground 2.

In the preferred configurations, approximately 30% to 45% of the line post 10 is below the surface of the ground 2.

In one configuration, the line posts 10 are approximately 1400 mm tall. Preferably, 1000 mm of the post is above the ground surface 2, and 400 mm is below the ground.

In other configurations, the plurality of line posts 10 may be surface mounted, the post being substantially on top of the ground 2.

In the preferred configurations, the line posts 10 comprise a substantially rectangular cross-section. In some configurations, the corners of the line posts 10 are rounded which provides for safer posts, especially during the installation of the system.

Other profiled line posts 10 are also anticipated such as posts with substantially oval, C-shaped, square, or circular cross-sections for example.

Figure 2:
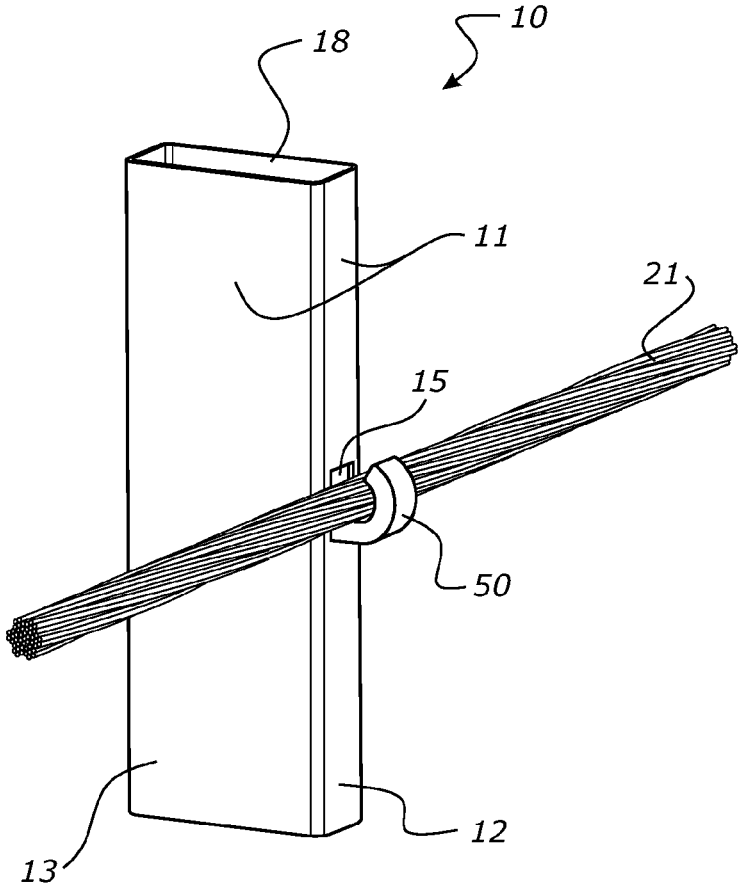
FIG. 2 shows a perspective view of a cable held by a cable holder.

Preferably, the line posts 10 are hollow, and forms a line post cavity 18 within the line post as best shown in FIG. 2.

Preferably, the line posts 10 are metallic (such as steel or galvanised steel), but may also be plastic in alternative configurations. It is anticipated that other materials with suitable strengths, and durability characteristics can be used to form the line posts.

Optionally, processes to protect the line posts 10 and/or other components of the wire rope safety barrier 1 may be used to increase the durability of the system to resist weathering, as the system is used outdoors. For example, the line posts 10 can be hot-dipped galvanised to resist corrosion.

Preferably, a plurality of cables 20 are attached to the line posts 10. Preferably, the plurality of cables extend between the line posts 20 to define a safety barrier along the roadway. The wire rope safety barrier 1 can help divide vehicles travelling in opposite directions and reduce the number accidents which occurred due to vehicles crossing a median. Alternatively, when installed along the side of the roadway, the wire rope safety barrier 1 can reduce the number or severity of vehicles crashing into obstacles such as poles, trees, buildings, or from driving into a ditch or down other steep slopes.

Preferably, the cables 20 are formed from galvanised steel wire rope. It is anticipated that other materials with suitable strengths, and durability characteristics can be used to form the cables.

In the preferred configurations, the diameter of the cables 20 is between 15 and 35 mm.

In one configuration, the diameter of the cables 20 is approximately 19 mm.

In some configurations, each cable 20 is formed from wire strands twisted or braided together to create a single thick and strong cable.

In one configuration, the cable 20 has a 3×7 strand arrangement for example.

Preferably, the cables 20 are attached to the line posts 10 in tension. Upon impact, preferably the cable 20 stretches elastically to absorb some impact energy.

Preferably, the cable 20 is pre-stretched to reduce loss of tension in service. In one configuration, the cables 20 are pre-stretched by 35%.

In the preferred configurations, at least one of said plurality of cables 20 is an external cable 21. An external cable 21 is defined as a cable which engages an outer surface 11 of a line post 10 as best shown in FIG. 2. Preferably, the external cable 21 engages the side surface 12 of the line posts 10. The side surface 12 is preferably the surface of the line post 10 which faces the roadway.

In the preferred configurations, at least one of said plurality of cables 20 is an internal cable 22. An internal cable 22 is defined as a cable which is installed to extend through the line post 10. Preferably, internal cables 22 pass through the front and back surfaces 13 of the line post 10. Preferably, internal cables 22 pass through the line post cavity 18.

The use of a combination of both internal and external cables may be beneficial, as each cable arrangement behaves differently, when impacted.

External cables 21 in cables holders may be beneficial as neighbouring cables may not be dragged along with a cable upon impact. The external cables may be able to provide resistance against impact more independently.

Internal cables 22 may be simpler to install and may require fewer or no further connecting elements to connect the cable to the post.

In the preferred configurations, each line post 10 comprises at least one cable holder slot 15. Preferably, each cable holder slot 15 is associated with a cable 21 in the wire rope safety barrier 1.

In the preferred configurations, the wire rope safety barrier 1 comprises cable holders 50 to hold one or more of the cables 20.

Preferably, the cable holder 50 is formed from aluminium. Alternatively, the cable holder is formed from other metal or non-metal materials with suitable physical characteristics such as strength and durability.

Optionally, the cable holder 50 receives a protective coating to improve its durability against weathering.

Preferably, each external cable 21 is connected to the line posts 10 by a cable holder 50 which is inserted through a cable holder slot 15. Preferably, the external cables 21 are connected to each line posts with an individual cable holder 50 extending through a corresponding cable holder slot 15.

Preferably, the cable holder slot 15 is located on a side surface 12 of the line post 10 as best shown in FIG. 2.

Preferably, the cable holder slot 15 includes an upper edge 16 and a lower edge 17.

Figure 5A:
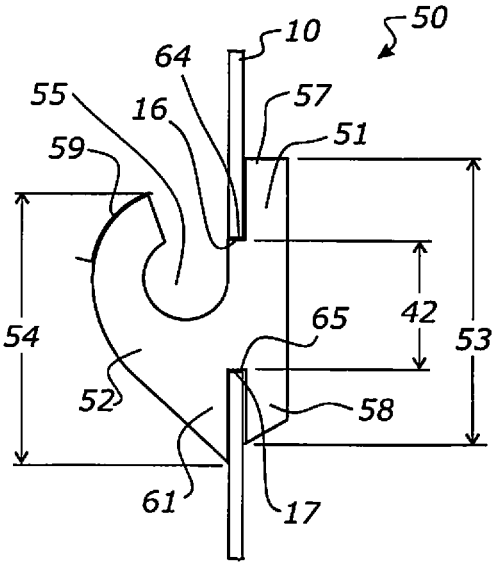
FIG. 5A-5D shows different cable holder profiles.

As referenced in FIG. 5A, the cable holder 50 preferably has a body portion 51 and a hook portion 52. Preferably, the hook portion 52 extends laterally from the body portion 51 of the cable holder 50.

The body portion 51 of the cable holder 50 is configured to engage with the line posts 10 to keep the cable holder in place.

In the preferred configurations, the body portion 51 is located within the line post 10 once installed. Preferably, at least a portion of the body portion 51 is located in the line post cavity 18.

Preferably, the hook portion 52 of the cable holder 50 protrudes externally through the cable holder slot 15 and supports an external cable 21.

The hook portion 52 is configured to form a cable receiving region 55 to receive an external cable 21.

In the preferred configurations, each cable holder 50 comprises a locating notch 65 at the bottom surface of the cable holder. The locating notch 65 is configured to engage with the lower edge 17 of a corresponding cable holder slot 15.

A locating notch 65 which is inserted and sits over the cable holder slot 15 may give rise to a more secure connection between the cable holder 50 and line post 10.

In the preferred configurations, the locating notch 65 comprises a substantially vertically extending notch. It is anticipated, that the locating notch 65 may be a different profile.

Preferably, the body portion 51 is elongate and includes a tail region 58. The tail region 58 is the body portion which is adjacent the locating notch 65. The tail region 58 extends downwards at the lower end of the body portion 51 and is configured to be located within the line post 10 when the cable holder 50 has been inserted.

In one configuration, the locating notch 65 opens (i.e. widens towards the lower surface of the cable holder 50). Preferably the location notch 65 widens as the tail region 58 tapers towards the lower surface of the cable holder 50. It should be appreciated this feature can improve ease of assembly, as the width of the locating notch 65 widens towards the lower end to make inserting of the cable holder 50 onto the cable holder slot 15 easier. The locating notch 65 narrows towards the top surface of the notch, such that the connection between the cable holder 50 and line post 10 is secure.

Preferably, the tail region 58 has a height which is approximately 10% to 30% the height 53 of the body portion.

Most preferably, the tail region 58 has a height which is approximately 15% to 25% the height 53 of the body portion.

Preferably the specific profile of the locating notch 65 limits the movement of the cable holder 50, especially rotational movement of the cable holder.

The specific connection of the cables 20 to the line posts 10, provides a simple and reliable rope safety barrier system as described in more detail later.

A wire rope cable barrier 1 as described is designed to have improved structural integrity and may be advantageous as it can help reduce fatalities or injuries due to crashes on the road. It is important to implement effective safety barrier systems to limit the severity of crashes especially on highways where vehicles travel at high speeds. Furthermore, robust road safety barriers are necessary to satisfy rigorous safety standards.

The wire rope safety barrier 1 can absorb impact energy to slow a vehicle down as the cables 20 catch the vehicle. The wire rope safety barrier 1 is a flexible system which can dissipate energy upon impact. Energy is dissipated due to deflection of the cables 20 and deformation of the components, where deflection is defined as the lateral displacement of the barrier upon impact.

Energy may also be dissipated through friction as a vehicle contacts the cables 20.

Additionally, impact forces may be absorbed in higher impact crashes due to deformation of the line posts 10. Additionally, or alternatively, other parts of the wire rope safety barrier 1, such as the cable holders 50 can operate to further resist the force of a vehicle upon impact by absorbing some impact energy (e.g. as the cable holders 50 deform). In particular, the shape, size and/or material of the cable holders 50 can be 'tuned' to give a preferred deformation characteristic. This may be beneficial where different barrier requirements need to be met to allow energy dissipation of the system.

As the impact energy is absorbed, the forces transmitted to the vehicle and experienced by occupants is reduced. Consequently, the severity of the accident is also reduced which can increase the likelihood of survival of vehicle occupants.

The wire rope cable barrier 1 as described may be advantageous as it is an easy and simple system to install. A safety barrier system which is to quick and simple to install is important as reducing the time required for installation also reduces associated costs, and closure times for lanes or roads. An easy and simple system may be especially desirable in areas where there are high crash rates, and maintenance or replacement of the whole or segments of the wire rope cable barrier system is required.

For example, in some crashes, simply the cable holders may need replacing. In higher impact crashes, the affected line posts 10 may be replaced. Other parts of the wire rope safety barrier 1 can be replaced as required depending on the type and intensity of the crash.

Line Posts

Preferably, the wire rope safety barrier system 1 comprises two or more cables 20 to form an effective barrier against vehicles upon impact.

In some configurations, the wire rope safety barrier 1 comprises three cables 20 extending between line posts 10 to define a safety barrier.

Figure 7A:
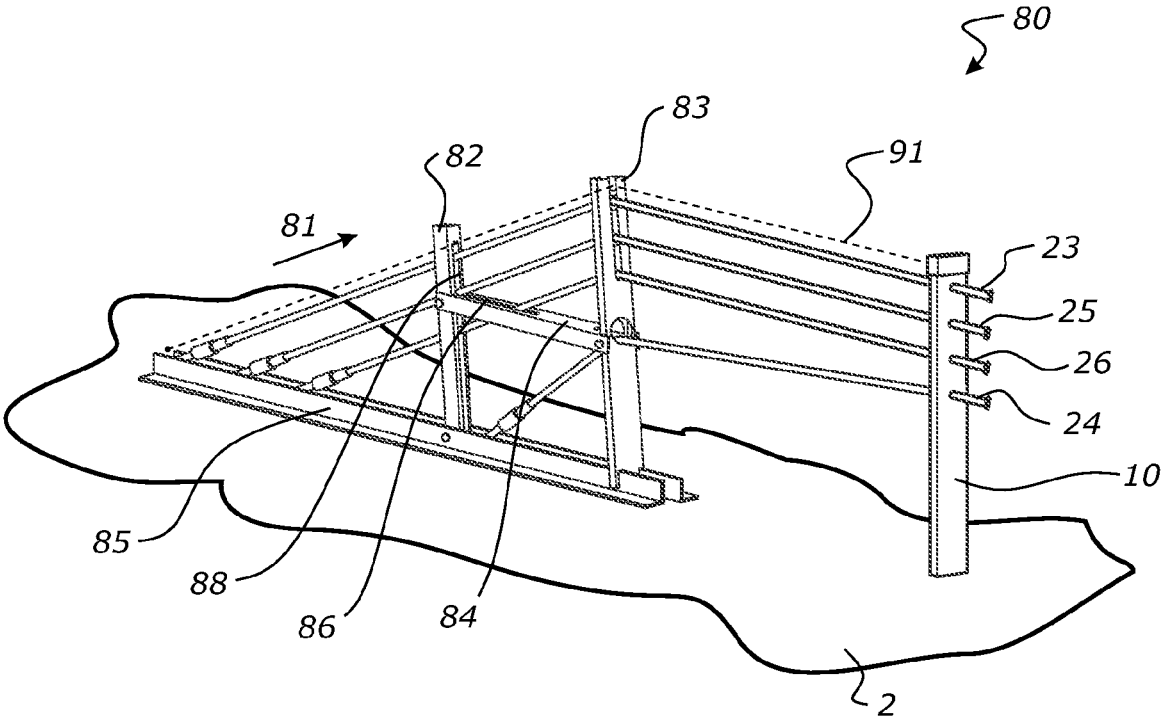
FIG. 7A shows a perspective view of a terminal end before impact.

In other configurations, the wire rope safety barrier 1 comprises four cables 20 extending between line posts 10 to define a safety barrier as illustrated in FIGS. 1 and 7A.

In yet another configuration, the wire rope safety barrier 1 comprises five cables (or more) 20 extending between line posts 10 to define a safety barrier.

In some wire rope safety barrier systems 1, only external cables 21 are present. In other systems, only internal cables 22 are present. In some systems, a combination of both external 21 and internal 22 cables are present.

In the preferred configurations, a wire rope safety barrier 1 has one to four external cables 21. The wire rope safety barrier 1 also has zero to four internal cables 22 (i.e. no internal cables may be present, or 1 or more internal cables may be present).

Any combination of cables 20 including external 21 or internal 22 cables is anticipated to achieve the desired physical properties of the wire rope safety barrier 1.

In some configurations, two of the plurality of cables 20, are external cables 21.

Figure 3A:
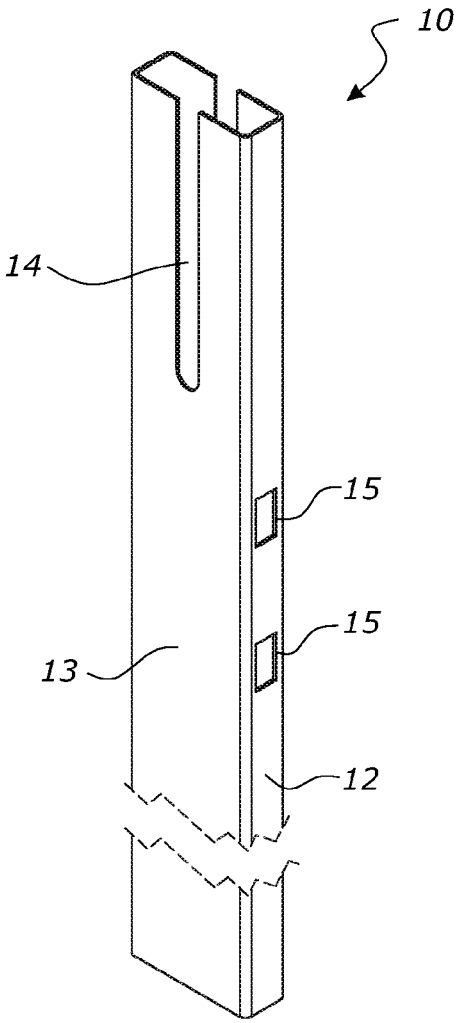
FIG. 3A shows a perspective view of a line post.
Figure 3B:
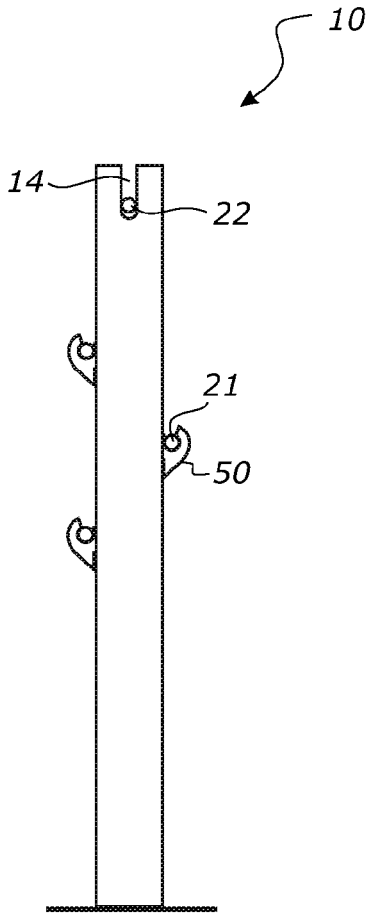
FIG. 3B shows a front view of a line post with cables.

In the preferred configuration, three of the plurality of cables 20 are external cables 21 as best shown in FIG. 3B.

In some configurations, one of the plurality of cables 20, is an internal cable 22. Preferably, a cable slot 14 receives the one internal cable 22.

In other configurations, two or more of the plurality of cables 20, are internal cables 22.

In the preferred configurations, each line post 10 comprises a cable slot 14 extending from an upper surface of the line post. The cable slot 14 is configured to receive one or more internal cables 21. The cables 20 located within the cable slot 14 are internal cables 22 as they run through the line posts 10.

Preferably, the cable slot 14 is approximately the width of a cable 20. In some configurations the cable slot 14 is between 15 and 30 mm wide. In one configuration, the cable slot 14 is 20 mm wide.

Preferably, the cable slot 14 has a height of 50 to 150 mm. In some configurations, the cable slot 14 has a height of 70 to 100 mm.

FIG. 3A and FIG. 3B illustrates one configuration of a line post 10. In this configuration, this line post is configured to support a plurality of cables 20. This wire rope safety barrier 1 comprises four cables 20.

Three of said plurality of cables are external cables 21.

Preferably, two of the three external cables 21 engage a first outer surface of said line posts and one of external cable engages a second opposing outer surface of said line posts, as shown in FIG. 3B. Cables on opposing sides of the line posts may be beneficial to resist impact from vehicles may occur on either side of the line post (such as when the cable barrier system is located along the median of the road).

In configurations where there are a plurality of external cables 21, it is anticipated that the external cables may engage the same outer surface of the line posts or the external cables may engage opposing outer surfaces of the line posts. All different arrangement of external cables 21 engaging the outer surfaces of the line posts are anticipated.

Preferably, the cables 20 in some configurations are located at different heights above the ground 2 to provide different points of contact with a vehicle, to increase the likelihood of engagement with a crashing vehicle.

Preferably, in this configuration, one cable 22 is located in a cable slot 14. Preferably, the one cable is inserted into the cable slot 14 extending from an upper surface of the line post 10.

Optionally, the line posts 10 further comprises a cap 9 located on of the upper surface of the line posts as referenced in FIG. 1. In some configurations, the cap 9 can be configured to help retain internal cables 22 within the line post slot 14. The cap 9 may also help limit weathering of components of the line posts 10.

In some configurations, the cap 9 comprises projections to retain of the cap 9 on the line post 10. In some configurations, the projections are internal projections which extend from the inner surface of the cap 9, and are configured to engage with a surface of the line post 10. In other configurations, friction-fit of the cap is sufficient, and projections are not necessary to retain the cap.

In the preferred configurations, the cable holder slot 15 is sized and profiled to keep the cable holder 10 (and therefore the cables 21) engaged with the line post 10.

Figure 4:
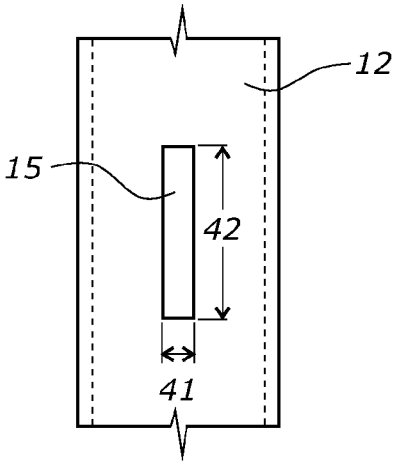
FIG. 4 shows a side view segment of a line post.

As referenced in FIG. 4, the cable slot 15 preferably comprises a generally rectangular profile.

Preferably, the cable slot 15 has a profile which corresponds to the cross-sectional profile of a cable holder 50.

Preferably, the cable holder slot has a width 41 between 5 mm and 10 mm.

Preferably, the cable holder slot 41 has a similar width to the cable holder 50 to keep the cable holder in place and prevent or limit rotation upon impact.

Preferably, the cable holder slot has a height 42 between 20 mm and 40 mm.

In the preferred configurations, the cable holder slot 15 has a height 42 less than the height 53 of the body portion 51 of the cable holder, as referenced in FIG. 5A.

Preferably, the cable holder slot 15 also has a height 42 less than the height 54 of the hook portion 52 of the cable holder 50.

A cable holder slot 15 with a height 42 less than the body 51 of the cable holder 50 helps prevent unwanted removal of the cable holder 50 when the cable holder is displaced in the lateral direction only. Preferably, the cable holder 50 is obliquely inserted into the cable holder slot 15, and therefore needs to be removed obliquely, described in more detail later.

Preferably, the locating notch 65 has a width approximately the thickness of a sidewall of the line post 10.

Cable Holder

Figure 5B:
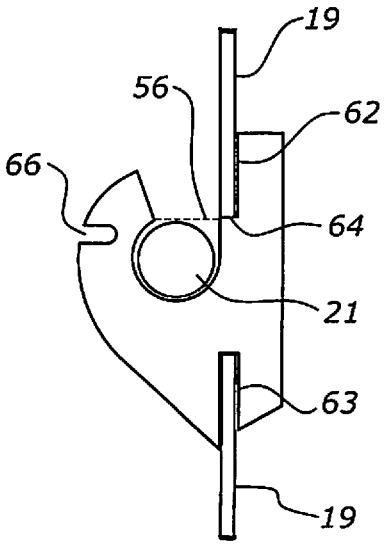
Figure 5C:
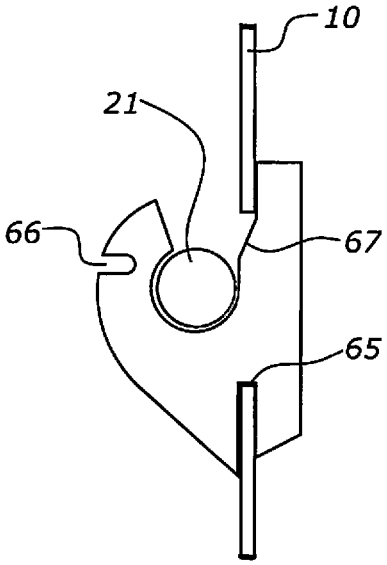

As shown in FIGS. 5A to 5C, cable holders 50 may be of different profiles to provide specific connections between the cables 20 to the line posts 10 with certain characteristics.

Upon impact, there are two main modes of failure in relation to external cables 21, where the cables disconnect from the wire rope safety barrier 1.

A first mode of failure is where an external cable 21 is released in the vertical direction. When a sufficient vertical upwards force is applied, the cable 21 separates from the cable holder 50, by passing out of the hook portion. In some modes of failures, elastic deformation may occur for the cable 21 to escape the cable holder 50. In alternative cases, plastic deformation may be necessary for the cable 21 to escape the cable holder 50.

Another mode of failure is where an external cable 21 is released in the lateral direction. When a predetermined threshold force is applied in the lateral direction, the cable 21 can be released if a segment of the hook portion 52 deforms out of the way to provide a new exit pathway for the cable. In some cases, the hook portion 52 breaks away. In the second mode of failure, generally plastic deformation occurs as the cable 21 escapes the cable holder 50.

In the preferred configurations, the hook portion 52 forms a cable receiving region 55 as referenced in FIG. 5A. An external cable 21 is configured to be received by the hook portion 52 and is located in this region when the barrier has been installed. Preferably, cables 20 are installed by connecting at least one cable to the line posts 10 by positioning a cable into the cable receiving region 55 of the cable holders 50 such that the cables 20 extend between the line posts 10 to define a safety barrier along the roadway.

Preferably, the hook portion 52 forms a constricted exit passage 56 configured to allow a cable 22 to enter and exit the cable receiving region 55 once a first threshold force is applied to the cable. Preferably, the external cable 21 will have to overcome some resistance before exiting the exit passage 56 due to the restriction. The constricted exit passage 56 may have a width which is smaller than the diameter of the cable receiving region 55.

Preferably, the cable 20 enters or exits the cable receiving region 55 once a first threshold force is applied to the cable to move the cable past the constricted exit passage 56 formed by a constricting portion 59.

The constricted exit passage 56 may be formed between the constricting portion 59 and the line post 10.

By having a constricted exit passage 56, the cable holder 50 is preferably able to retain the cable 21 in the cable receiving region 55 for a longer period of time or resist higher forces upon impact. A constricted exit passage of 56 increases the threshold force required for the cable 21 to the release via the first mode of failure.

Preferably, the constricted exit passage 56 is wide enough for the cable 21 to be inserted upon installation of the wire rope safety barrier 1. However, the constricted exit passage 56 is narrow enough to form some restriction against unwanted release of the cable 22.

In some configurations, the constricted exit passage 56 has a width substantially the same as the cable 21 diameter. Substantially is defined as "for the most part".

Most preferably, the constricted exit passage 56 has a width smaller than the cable 22 diameter. To enter the cable receiving region 55, the cable holder elastically deforms to allow the cable 21 to enter.

In the preferred configurations, a constriction portion 59 of the hook portion 52 forms the constricted exit passage 56. As illustrated in FIG. 5A, the constriction portion 59 is a segment of the hook portion 52 which extends upwards from its horizontal centreline.

Following the impact of a vehicle, the vehicle can cause a whip wave which is a wave which travels along the cable 21. During a whip wave, the cable 21 can move upwards with force and away from the cable receiving region 55, such that the cable becomes dislodged.

Figure 10:
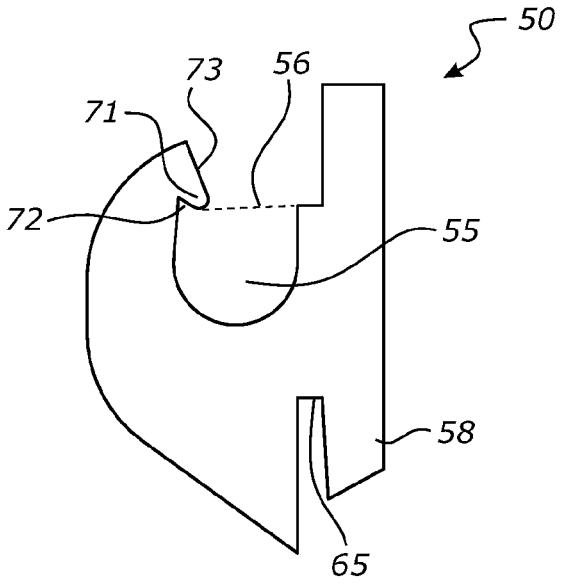
FIG. 10 shows a cable holder with a barb feature.

In one configuration, the cable holder 50 further comprises a barb feature 71 as shown in FIG. 10. The barb feature 71 preferably retains the cable 21 in the cable receiving region 55 for a longer period of time or resist higher forces upon impact, such as during a whip wave follow impact. Preferably, the barb feature 71 can help retain or prevent the cable 21 from dislodging from the cable holder 50 during a whip wave.

The barb feature 71 is a projection located preferably at or towards an end of the hook portion 52. Most preferably, the barb feature 71 is a projection on the constricting portion 59 of the hook to further help retain the cable 21 in the cable holder 50 during and/or after impact.

The barb feature 71 helps retain the cable 21, as the cable gets caught or 'snags' on the barb feature, if the cable 21 moves upwards and outwards from the cable receiving region 55. This may be particularly effective where the cable 21 has a strand arrangement (the cable is formed from wire strands twisted or braided together).

Preferably, the barb feature 71 projects inwardly towards the cable receiving portion 55 of the cable holder. In the preferred configuration, the barb 71 projects both inwardly and downwardly towards the cable receiving portion 55 of the cable holder as shown in FIG. 10.

Preferably, the barb feature 71 forms a catching region 72 on the underside of the barb feature. The catching region 72 is adapted to catch and retain the cable 21, when the cable moves upwards. The catching region 72 helps to prevent the cable 21 from dislodging from the cable holder 50 as the cable moves upwards, such as in a whip wave.

In the preferred configurations, an end surface 73 of the cable holder is angled inwardly and downwardly cable receiving region 55 (as referenced in FIG. 10). An end surface 73 which is angled inwardly and downwardly can improve ease of cable 21 installation into the cable holder 50. As the end surface 73 is angled, the cable holder 50 forms the constricted exit passage 56. This hook profile improves the ease cable 21 installation (as the cable moves into the cable receiving region 55) and makes removable of the cable more difficult (as the cable moves up and out of the cable receiving region it limits the exit pathway to a narrow directional band, i.e. removing the cable is difficult unless along a specific direction). Alternatively, the constriction may be smaller than the cable diameter (i.e. requiring deformation of the cable holder).

In the preferred configurations, an inner surface 19 of the line post engages with the body 51 of the cable holder 50 which is located within the line post to resist lateral movement upon impact. Preferably, the body region 51 is generally elongate.

Upon impact, a vehicle may pull the cables 20 in a lateral direction, biasing the cable holder 50 in the lateral direction. As the body 51 of the cable holder 50 within the line post 10 engages with the inner surface 19 of the line post, the cable holder is prevented from exiting the cable holder slot 15. The cable holder 50 is initially unable to escape as the inner surface 19 of the line post blocks the body 51 of the cable holder within the line post 10 from exiting.

As referenced in FIG. 5B, a side surface 62 of the upper region 57 engages with the inner surface 19 of the line post to resist lateral movement.

In some configurations, a side surface 63 of the tail region 58 engages with the inner surface 19 of the line post to resist lateral movement.

In some configurations, as shown in FIG. 5A, each cable holder 50 comprises an engaging notch 64 on the body portion configured to engage with the upper edge 16 of a cable holder slot to resist upward movement of the cable holder as the cable pulls the cable holder upwardly upon impact.

Preferably, the engaging notch 64 catches the upper edge 16 of the cable holder slot when a force in the upwards direction is applied.

In the preferred configurations, as shown in FIG. 5B, the hook portion 52 of the cable holder 50 comprises a region of weakness 66 configured to allow a segment of the hook portion to deform and release the cable 21 when a lateral force exerted by the cable is greater than a predetermined threshold.

Preferably, the region of weakness 66 allows the hook portion 52 to deform or break at a predetermined fail line when a lateral force applied to cable holder 50 is greater than the predetermined threshold upon impact.

A region of weakness 66 in the cable holder 50 may be a useful feature, as it helps control the location of failure upon impact. Upon impact, a vehicle may displace the cables 20 on the wire rope safety barrier 1. As the cables 20 are displaced, the external cables 21 exert a force on the cable holders 50, which in turn can break via the second mode of failure.

In some configurations, the region of weakness 66 is a reduction of the cross-sectional area in the hook portion 52.

Preferably, the region of weakness 66 comprises a cross-sectional area being approximately 40% to 80% the cross-sectional area of the rest of the hook portion.

In some configurations, the region of weakness 66 is a notch on the outer hook surface as illustrated in FIG. 5B.

In other configurations, the of weakness 66 is a notch on the inner hook surface adjacent a cable receiving region 55 (not shown).

In some configurations, the region of weakness 66 is located at a lower segment of the hook portion 52.

In some configurations, the region of weakness 66 is located at a side segment of the hook portion.

In some configurations, as referenced in FIG. 5C, each cable holder 50 comprises a ramp 67 at a top surface of the body portion 51 configured to guide the cable holder into the line post 10 when the cable holder is lifted upwards upon impact.

In the preferred configurations, the ramp 67 slopes downwardly and outwardly towards the hook portion 52. Preferably, the ramp 67 is located between a top end of the body portion and the cable receiving region.

A cable holder 50 with a ramp 67 as shown in FIG. 5C, can help retain the cable 21 in the cable holder until a relatively high threshold force is applied.

Preferably, the cable holder 50 rocks backwards into the line post 10 after the locating notch 65 disengages from the cable holder slot as a ramp 67 on the body portion 51 guides the cable holder inwards as the cable holder moves upwards.

Figure 5D:
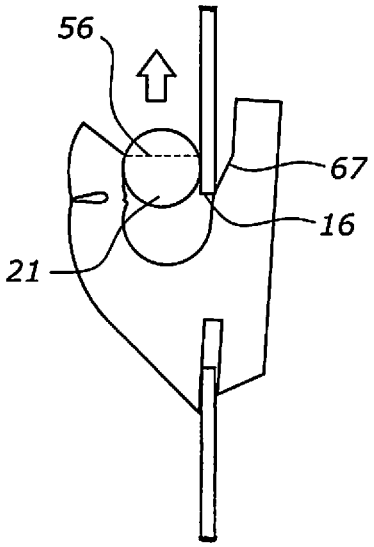

FIGS. 5C and 5D illustrate the steps for releasing a cable upon impact for a cable holder 50 including a ramp feature 67.

Prior to impact, the cable holder 50 sits in the cable holder slot 15 of the line post 10 as shown in FIG. 5C.

Upon impact, the cable holder 50 is lifted upwards upon impact and the locating notch 65 disengages from the lower edge 17 of the cable holder slot 15.

As the cable holder 15 moves upwards, the ramp 66 runs along the upper edge 16 of the slot 15. The profile of the ramp 66 guides the cable holder 50 upwards and inwards in relation to the line post 10. As the cable holder 50 moves upwards, a greater portion of the cable holder also moves inwards into the line post 10 into its cavity 18.

Preferably, the width of the constricted exit passage 56 reduces as the cable holder 50 is lifted upwardly and into the line post 10 upon impact as the ramp bears upon the upper slot edge. As the constricted exit passage 56 reduces in width, the cable 21 will have to overcome a greater threshold force before being about escape the cable holder via the first mode of failure (vertically upwards). In some cases (such as when the constricted exit passage 56 has reduced significantly in size), the cable 21 may not be able to escape the cable holder 5 vertically upwards, via a first mode of failure. Instead, the cable 21 may only be able to escape via the second mode of failure (laterally).

Therefore, in some configurations the cable 21 can only exit the cable receiving region 55 when a second threshold force is applied. Preferably, the second threshold force is greater than the first threshold force due to the reduction of width of the constricted exit passage 56.

In some configurations the cable holder 50 plastically deforms at least in the hook portion as the cable 21 exits the cable receiving region as shown in FIG. 5D.

Insertion Method

As illustrated in FIGS. 6A to 6D, there is provided a method for inserting a cable holder 50 into a cable holder slot 15 and a line post 10.

There are various features of the illustrated insertion method which aims to improve the ease of installation of a wire rope safety barrier 1. An efficient method of installation may be an important consideration, as reducing installation time can also help reduce labour costs and lane or road closure time. Installation of cable holders 50 into line posts 10 may be required during a new wire rope safety barrier 1 set-up, for maintenance, or after a crash.

In the preferred configurations, each external cable 21 has a corresponding cable holder 50. Preferably, each cable holder 50 only receives one cable 21. This may be advantageous over other wire rope road barrier systems, as the number and location of cables 20 may be easily customised to satisfy different barrier requirements. Furthermore, this system is advantageous as the cables 20 may be fitted onto the line posts 10 by being inserted into the cable holders 50 without tools.

Figure 6A:
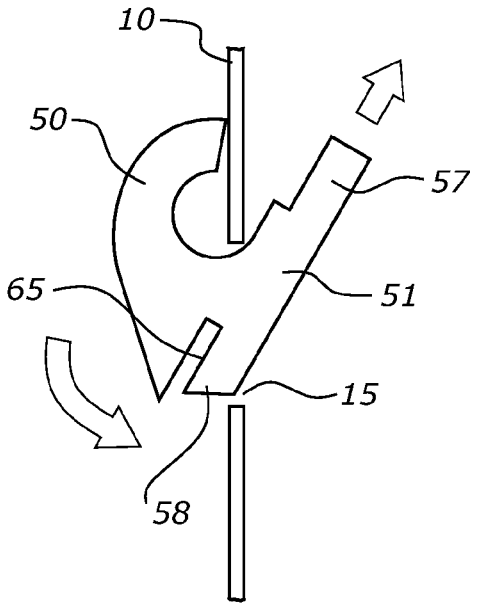
FIG. 6A-6D shows a sequence of steps for inserting a cable holder into a post.

As illustrated in FIG. 6A, preferably the cable holder 50 is obliquely inserted into the cable holder slot 15 by first inserting an upper region 57 of the body portion 51 into the cable holder slot.

Obliquely inserting the cable holder 50 into the cable holder slot 15 may be beneficial, as it will be more difficult for the cable holder 50 to separate from the line post 10. In order for the cable holder 50 to escape the line posts 10, the cable holder 50 will need to rotate in a direction opposite to the first direction, and be removed obliquely. Otherwise, the cable holder 50 will need to deform before the cable 21 can be released.

The cable holder 50 coupled with the cable holder slot 15 as discussed, helps the wire rope safety barrier 1 withstand vehicle crashes efficiently.

Figure 6B:
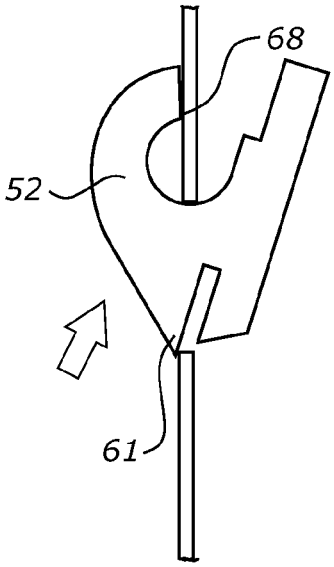

In some configurations, as illustrated in FIG. 6B, the cable holder 50 includes a particular hook portion 52 profile which helps define or limit the rotation of the cable holder in relation to the cable holder slot 15.

In the preferred configurations, the profile of the cable holder 50 prevents it from falling inside the line post 10.

In the preferred configurations, as the cable holder 50 is obliquely inserted into the cable holder slot 15, the flat end surface 68 of the hook portion 52 contacts the outer surface of the line post 10, to limit the degree of rotation of the cable holder in a first direction into the line post. Limiting rotation in this direction prevents the cable holder 50 from going too far into the line post cavity. Once a flat end surface 68 of the hook portion 32 contacts the outer surface of the line post 10, the cable holder 50 stops rotating in the first direction.

In some configurations, the cable holder 50 comprises a lower locating protrusion 61 at the lower surface of the cable holder. The lower locating protrusion 61 is configured to guide the cable holder 50 to the lower edge 17 of the cable holder slot 15.

Preferably, when the cable holder 50 is pushed in/up as far as it can go into the post, the cable holder 50 is prevented from falling into the line post 10 as the lower locating protrusion 61 engages the lower edge 17 of the cable holder slot.

The cable holder 50 will not be lost into the line post 10 as its profile allows it to be inserted and sit on a cable holder slot 15, but not be fully inserted through the cable holder slot so that the cable holder would be lost inside the line post.

The lower locating protrusion 61 feature may also be useful for installers of the wire rope safety barrier where ease of installation of cable holders 50 onto line posts 10 can be improved, as installers can rely more on feel/physical sensations rather than simply relying on vision during installation.

Preferably the lower locating protrusion 61 extends from the lower surface of the hook portion 52.

Preferably, the lower locating protrusion 61 extends lower than the tail region 58 of the cable holder 50.

Figure 6C:
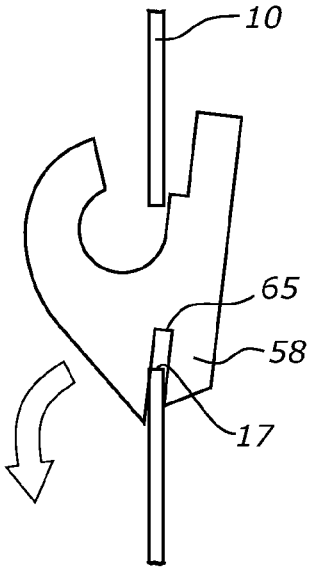

After the desired portion of the cable holder 50 has been obliquely inserted into the cable holder slot 15 to a desired orientation and position, the cable holder 50 is lowered and inserted onto the line post 10 as illustrated in FIG. 6C.

Preferably, the cable holder 50 is lowered onto the lower edge 17 of the cable holder slot 15 after the tail region 58 of said body portion 51 has been inserted within the line post 10.

Preferably, the locating notch 65 is positioned over the lower edge 17 of the cable holder slot 15.

Figure 6D:
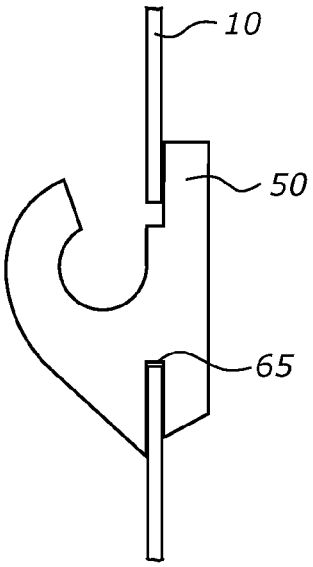

Once the cable holder 50 has been installed, preferably the locating notch 65 sits over and engages the lower edge 17 of the cable holder slot 15 as shown in FIG. 6D.

Terminal End

As shown in FIG. 7A, a wire rope safety barrier 1 comprises a terminal end 80. The cables 20 are typically anchored at the terminal ends 80.

Preferably, the wire rope safety barrier 1 comprises an anchor 85 at the terminal end 80 to receive and secure the plurality of cables 20. Anchor systems 85 known in the art may be used to anchor and secure the cables 20 at the terminal ends 80.

For example, as illustrated in FIG. 7A, cables 20 are secured to an anchor 85 by anchor plates at predetermined locations along the anchor. To secure the anchor 80 into the ground 2, piles may be driven into the ground and held by foundation, or a terminal end may be held by foot plates which include tubes driven into the ground. It is anticipated that other anchor securing methods known in the art may be used.

Preferably, the wire rope safety barrier 1 terminates at two opposing terminal ends 80. In some cases, a vehicle may crash against a terminal end 80 of a wire rope safety barrier 1. It is preferable, that a rope safety barrier system includes features to improve the safety of terminal end 80 crashes, to increase the likelihood of survival and reduce severity of crashes.

In some instances, vehicles may crash head-on against a terminal end (a direction substantially parallel to the longitudinal axis of the cables 20). In these situations, the vehicle will not slow down much (or at all) by deflection of the cables 20, as cables usually deform in a lateral direction (not longitudinal direction), absorbing some impact injury in the process. Instead, it may be preferable to adopt other methods to absorb energy or prevent injury at terminal ends.

Terminal end crashes may be particularly dangerous where cables remain in tension and act as a ramp 81 as referenced in FIG. 7A. Cables may act as a ramp when they are connected at or towards the ground to the anchor 85.

An errant vehicle travelling in a directing towards a terminal end may ride up the ramp 81 created by the cables. This is dangerous as the vehicle may be lifted off the ground, become unstable, and may lead to serious injury.

Releasing some tension in the cables 20 upon impact at the terminal end 80 helps prevent vehicles from driving up a ramp 81 created by inclined cables at the terminal end may therefore be desirable. Driving up the ramp 81 could be dangerous as vehicles may become destabilised or may launch upwards resulting in more damage to the vehicle and its occupants and in some cases, other vehicles driving by.

Upon impact at the terminal end 80, preferably movement of the trigger post 82 and the deflection post 83 causes the cables 20 to release some tension. Collapsing the deflection post 83 will de-tension the cables 20.

Preferably, the wire rope safety barrier 1 is a non-releasing system. Preferably, the cables 20 remain anchored after impact. An advantage of a non-releasing system is so that the cables 20 are not released and cause further damage by hitting the vehicle for example.

Another advantage of a non-releasing system over releasing systems is that the barrier may have residual capacity to act as a barrier against secondary impacts.

In the preferred configurations, the terminal end 80 comprises a trigger post 82 and a deflection post 83 as referenced in FIG. 7A. Generally, the trigger post 82 is the first (or last) post in the wire rope safety barrier. Line posts are typically posts located between the trigger posts, and generally a plurality of line posts form a substantial length of the safety barrier.

Preferably, the deflection post 83 is adjacent the trigger post 82.

Preferably, the deflection post 83 is positioned between the trigger post 82 and the plurality of line posts 10.

Preferably, the plurality of cables 20 extend between the trigger post 82 and the deflection post 83.

In the most preferred configurations, the terminal end 80 comprises a strut connector 84 connecting the trigger post 82 and the deflection post 83.

Preferably, the terminal end 80 includes a trigger post connection between a first end of the struct connector 84 and a connection region on the trigger post 82 between a top and base region of the trigger post.

Preferably, the terminal end 80 includes a deflection post 83 connection between a second end of the struct connector 84 and a connection region on the deflection post between a top and base region of the deflection post.

Preferably, the strut connector 84 is a generally rectangular member.

In some configurations, the trigger post 82 comprises a slot 88 extending in a longitudinal direction to allow one or more cables to pass through.

Preferably, the struct connector 84 is substantially horizontal as the trigger post connection and deflection post connection is approximately at the same height above a ground surface.

Preferably, the strut connector 84 comprises a slot 86 extending from one end in a longitudinal direction to allow one or more cables 20 to pass through. Preferably, the slot 86 extends from the end closes to the trigger post 82 as the cables 20 generally ramp downwards in a direction towards the trigger post.

Figure 7B:
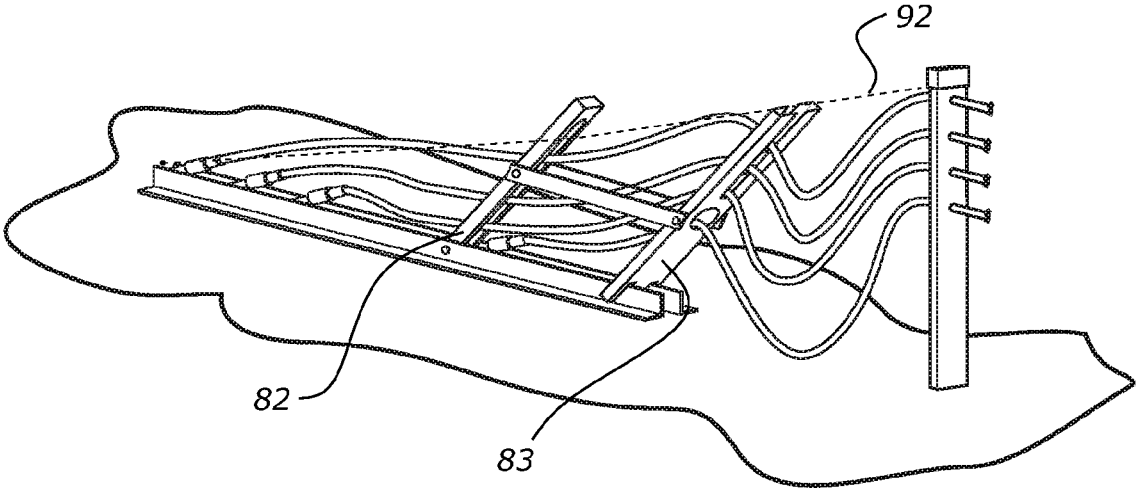
FIG. 7B shows a perspective view of a terminal end after impact.

As illustrated in FIG. 7B, as the trigger post 82 is forced from an upright position to a collapsed position upon impact, the deflection post 83 also collapses. As the deflection post 83 collapses, the cables 20 de-tension.

Figure 9A:
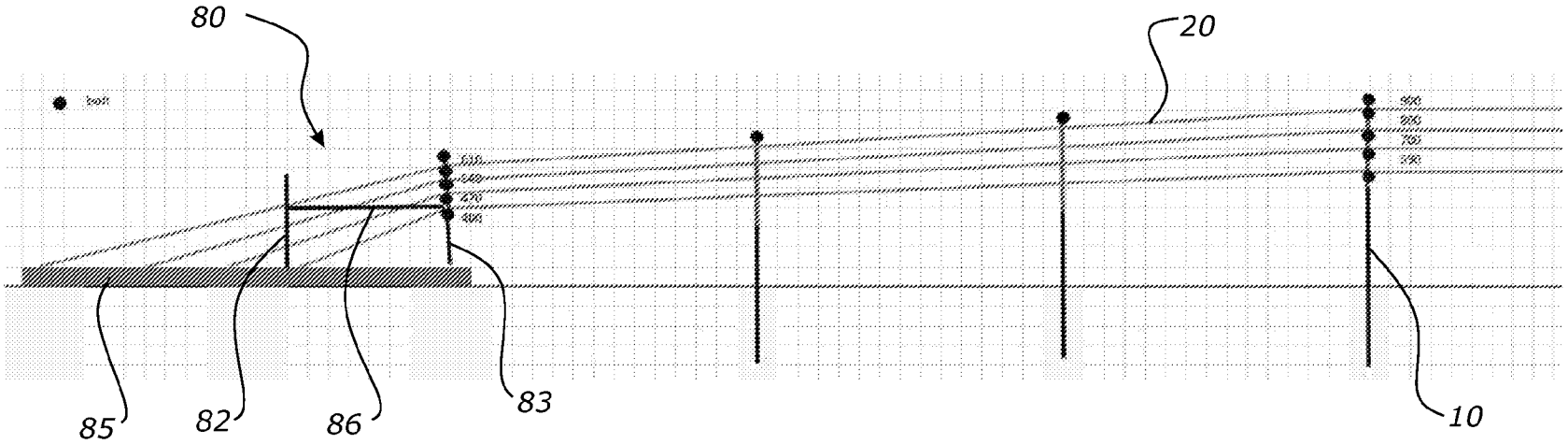
FIG. 9A shows a schematic of a wire rope safety barrier before impact.
Figure 9B:
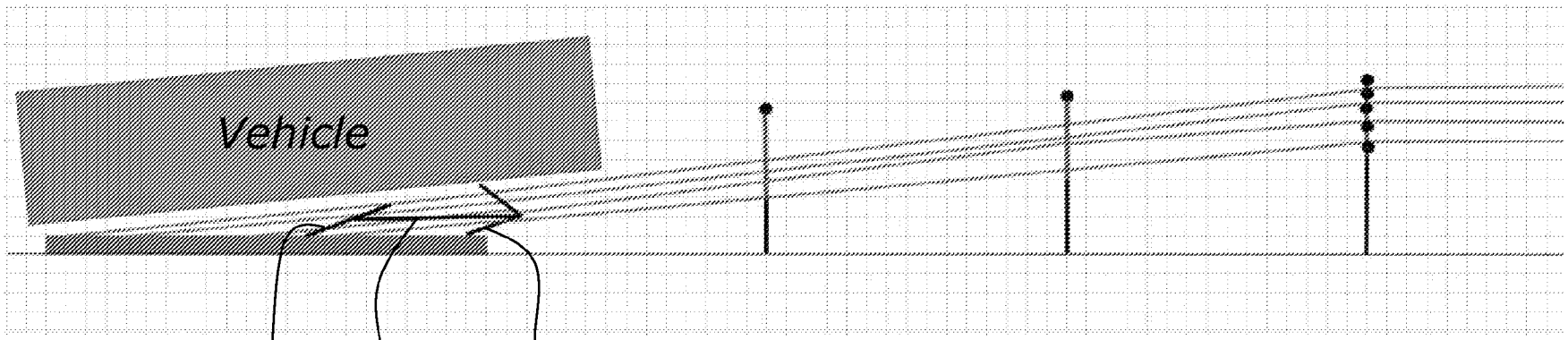
FIG. 9B shows a schematic of a wire rope safety barrier after impact.

As illustrated in the schematics of FIGS. 7B and 9B, as the trigger post 82 is impacted and forced from an upright position the connector strut 84 transfers force to the deflection post 83 and both deform and collapse as the connector strut 84 is forced into the deflection post 83. (Note the deformation of the deflection post 83 in FIG. 9B has been exaggerated to illustrate this feature).

As the trigger post 82 and the deflection post 83 deform, some of the impact energy is absorbed by the posts, and the terminal end is assisted to collapse thereby reducing the ramp effect to the vehicle.

In some configurations, the trigger post 82 is hinged to the anchor 85 and therefore will be free to rotate relatively easily upon impact.

Preferably, the deflection post 83 is connected to the anchor 85. Preferably, the deflection post 83 is fixed to the anchor 85, and the deflection post 83 will not rotate easily like the trigger post 82.

Preferably, the struct connector 84 is located between 250 mm and 500 mm above the ground surface 2 of the roadway.

Preferably, the struct connector 84 is located between 350 mm and 450 mm above a ground surface 2 of the roadway.

In the preferred configurations, the struct connector 84 is attached to the deflection post 83 at a height approximately midway up from a ground surface 2 or higher.

Preferably, the deflection post connection is at a height approximately midway between the top and base region of the deflection post.

Consequently, upon impact, the force experienced by the trigger post 82 can be effectively transferred to the deflection post 83.

In the preferred configurations, the trigger post 82 is pivotable between an upright position (FIG. 7A) and a collapsed position (FIG. 7B) upon impact. Preferably upon impact, where the vehicle hits the trigger post 82 first, causing it to fall towards a collapsed position, the deflection post 83 also moves towards a collapsed position. This is due to the trigger post 82 transferring force to the deflection post 83 upon impact. As the posts collapse, the vehicle is less likely to nosedive at the terminal end 80.

Upon impact, the deflection post 83 preferably rotates about a connection point. In some configurations, the connection point is the point where the deflection post 83 is connected to the anchor 85.

Upon impact the deflection post 83 deforms upon impact and absorbs some energy near the connection region on the deflection post and absorbs some energy from the impact as shown in FIG. 9B. The amount of deformation will be dependent on each particular crash.

Preferably, the cables 20 are held in tension when the deflection post 83 is in an upright position as shown in FIG. 7A.

Preferably, the cables 20 release tension/slack as the deflection post 83 moves towards a collapsed position upon impact as shown in FIG. 7B. The amount of tension released depends on the system. FIG. 7B is a schematic, and exaggerates the amount of slack in the cables 20 post-impact.

The cables follow a first cable path 91 between an anchor 85 and a line post 10 when the deflection post 83 is in an upright position (FIG. 7A). The cables 20 follow a second cable path 92 between the anchor 85 and the line post 10 when the deflection post 83 moves towards a collapsed position (FIG. 7B. Preferably, the distance of the second cable path 92 is less than the first cable path 91. As the second cable path 92 is shorter, the cables 20 slack as the length of cable between the anchor 85 and the line post 10 is greater than the distance between the anchor and line post.

In some configurations, the deflection post 83 comprises a slot 87 extending from an upper region in a longitudinal direction to allow one or more cables 20 to pass through. Upon impact the cables may travel down the deflection post slot 87 as they de-tension. This may be beneficial as the relative height of the cables 20 lowers upon a terminal end crash, reducing the likelihood of vehicle ramping which is dangerous.

One or more cables 20 can pass through the deflection post slot 87 as illustrated in FIG. 7A. In some configurations, all the cables 20 pass through the deflection post slot 87 as illustrated in 8B.

Cable Wire Positions

Preferably, the plurality of cables 10 are arranged to catch an errant vehicle and reduce the severity of impact. Preferably, the height of the cables 10 are arranged at or lower than the height of most vehicles.

In the preferred configurations, a topmost cable 23 of the plurality of cables is connected to the line posts 600 mm to 1200 mm above a ground surface 2 of the roadway.

Preferably, the topmost cable 23 of the plurality of cables is connected to the line posts 800 mm to 1000 mm above a ground surface of the roadway.

Preferably, a second cable 25 is connected to the line posts 500 mm to 850 mm above a ground surface 2 of the roadway.

Preferably, a third cable is 26 is connected to the line posts 450 mm to 800 mm above a ground surface 2 of the roadway.

In the preferred configurations, a lowermost cable 24 of the plurality of cables is connected to the line posts 400 mm to 650 mm above a ground surface 2 of the roadway.

In one configuration as shown in FIG. 9B, the wire rope safety barrier 1 comprises one or more transition posts between the terminal end and the plurality of line posts. Transition posts are posts which are different to the line posts (e.g. in height) as provides a region of transition between the line posts and the terminal end.

In one configuration, the heights of the transition posts gradually reduce from the line posts toward the terminal end.

In some configurations, the cables progressively incline downwards from the line posts towards the terminal end. In some configurations, the cables progressively incline downwards as they are connected to transition posts of gradually reducing height.

Preferably, the height of each transition post reduces relative to a neighbouring posts. Posts which are closer to the terminal end 80 are shorter than the posts which are further away.

The gradual reduction of heights of the transition posts towards the terminal end 80 may improve the safety of the wire rope safety barrier 1.

As a vehicle impacts at the terminal end 80, the gradual slope created by the gradual change in height of the posts allows the vehicle to override the posts and/or the cables 20. Overriding the cables 20 and/or the post in this manner may help reduce the speed of the vehicle upon impact, and reduce the severity of the crash.

In some configurations, a lowermost cable 24 of the plurality of cables is at a different angle to the other cables.

As shown in FIG. 7A, in some configurations, the lowermost cable 24 of the plurality of cables is inclined downwards from a first line post 10 towards the deflection post 83. The inclined lowermost cable 24 may be beneficial in a reverse hit where a car crashes in a direction from the line posts 10 towards the trigger post 82. In this configuration, a vehicle bumper is less likely to be dangerously caught by the cables 20.

Figure 8A:
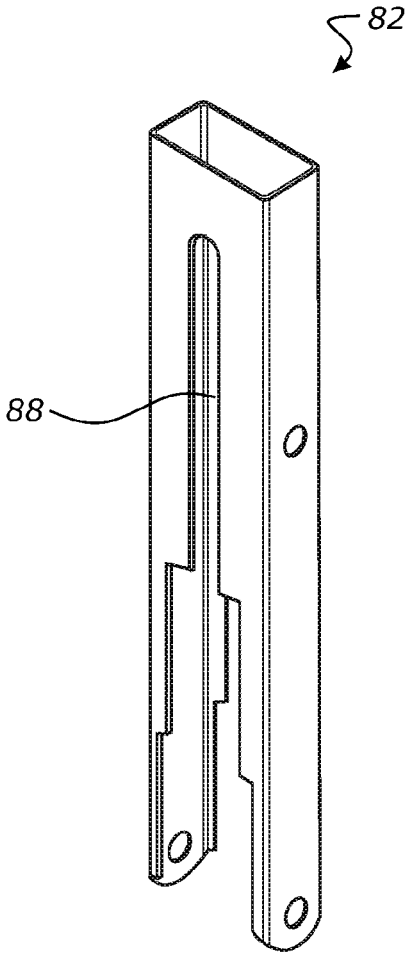
FIG. 8A shows a perspective view of a trigger post.

One configuration of a trigger post 82 is shown in FIG. 8A. Preferably, the trigger post 82 includes a trigger post slot 88 to allow one or more cables to pass through. In this configuration, the slot has different widths. The width of the trigger post slot 88 increases towards the bottom of the trigger post.

Figure 11A:
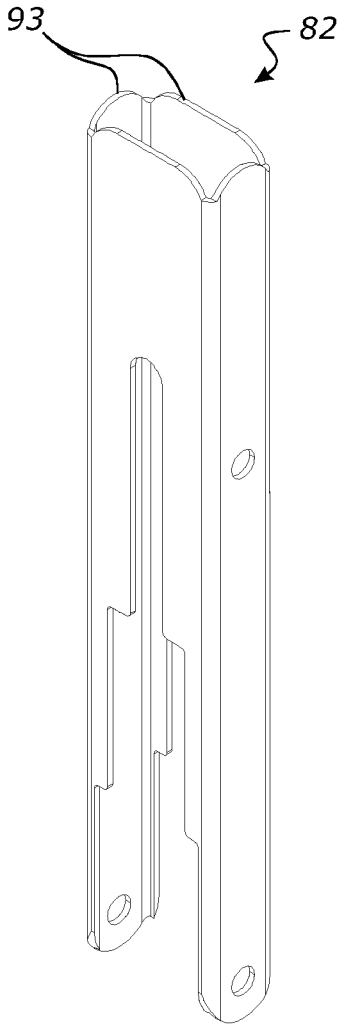
FIG. 11A shows a perspective view of a trigger post with rounded edges.

In some configurations as shown in FIG. 11A, top edges 93 of the trigger post 82 are rounded. The top edges 93 of the trigger post 82 are rounded to reduce the likelihood of scratching or penetrating through an underside of the vehicle upon impact. Penetration through the underside of the vehicle damages the vehicle and can cause injury if the post penetrates into the passenger compartment of the vehicle. Penetration of the post into the passenger compartment during testing may also cause the wire rope safety barrier to fail under some road safety barrier requirements.

Figure 11B:
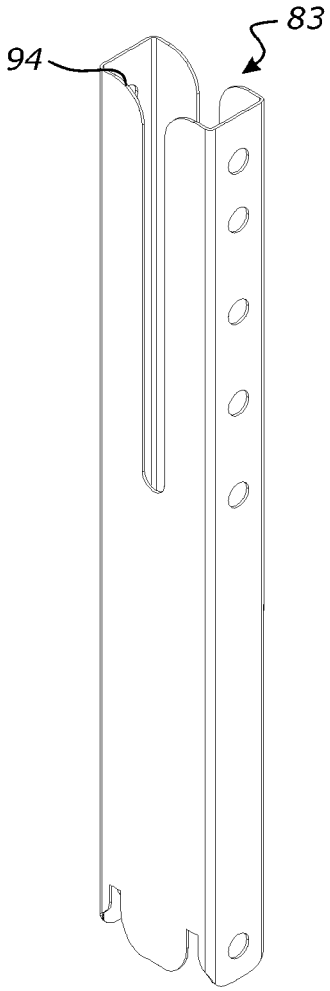
FIG. 11B shows a perspective view of a deflection post with rounded edges.

In some configurations as shown in FIG. 11B, top edges 94 of the deflection post 93 are rounded, for the same reason as provided above.

In a beneficial to increase the width of the trigger post slot 88 towards the bottom of the post, as a wider base may allow oversize cables to grip through. Furthermore, a wider trigger post slot 88 towards the bottom beneficial as it allows the trigger post 82 to collapse easier upon impact.

Figure 8B:
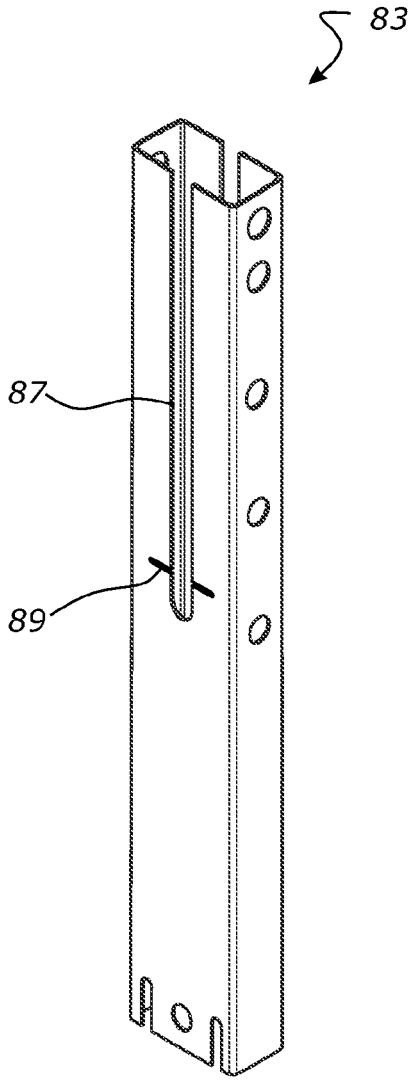
FIG. 8B shows a perspective view of a deflection post.

In some configurations as shown in FIG. 8B, the deflection post 83 comprises a region of weakness 89 configured to allow the deflection post to deform or break at a predetermined fail line when a force applied to the deflection post is greater than a predetermined threshold upon impact.

In some configurations, the region of weakness 89 is a horizontal groove extending at least partially across the deflection post 83 as shown in FIG. 8B.

To those skilled in the art to which the invention relates, many changes in construction and widely differing embodiments and applications of the invention will suggest themselves without departing from the scope of the invention as defined in the appended claims.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention claimed is:

1. A wire rope safety barrier comprising:

a plurality of line posts positioned along a roadway, each line post having at least one cable holder slot located on a side surface of the line post, the cable holder slot having an upper edge and a lower edge, a plurality of cables attached to the line posts and extending between the line posts to define a safety barrier along the roadway, at least one of the plurality of cables being an external cable located adjacent an outer surface of the line posts, each external cable being connected to the line posts by a cable holder inserted through the cable holder slot, the cable holder having a body portion and a hook portion, and each external cable engages between the hook portion and the line post, and wherein the body portion is elongate and an inner surface of the line post engages with the body of the cable holder which is located within the line post to resist lateral movement upon impact, and wherein each cable holder comprises a locating notch at a bottom surface configured to engage with the lower edge of a corresponding cable holder slot.

2. The wire rope safety barrier as claimed in claim 1 wherein the body portion of the cable holder is located within the line post and the hook portion protrudes externally through the cable holder slot and supports the external cable.

3. The wire rope safety barrier as claimed claim 1 wherein the hook portion forms:

a cable receiving region and a constricted exit passage configured to allow a cable to enter and exit the cable receiving region once a first threshold force is applied to the cable.

4. The wire rope safety barrier as claimed in claim 3 wherein the hook portion comprises a constriction portion and the constricted exit passage is formed between the constriction portion and the line post.

5. The wire rope safety barrier as claimed in claim 3 wherein the constricted exit passage has a width smaller that the cable diameter.

6. The wire rope safety barrier as claimed in claim 3 wherein the cable holder comprises a barb features to retain the cable in the cable receiving region, the barb feature forms the constricted exit passage.

7. The wire rope safety barrier as claimed in claim 1 wherein each cable holder comprises an engaging notch on the body portion configured to engage with the upper edge of the cable holder slot to resist upward movement of the cable holder as a cable pulls the cable holder upwardly upon impact.

8. The wire rope safety barrier as claimed in claim 1 wherein each cable holder comprises a ramp on the body portion configured to guide the cable holder into the line post when the cable holder is lifted upwards upon impact.

9. The wire safety barrier as claimed in claim 8 wherein the ramp is located between a top end of the body portion and a cable receiving region and the ramp slopes downwardly and outwardly towards the hook portion.

10. The wire safety barrier as claimed in claim 8 wherein a width of a constricted exit passage reduces as the cable holder is lifted upwardly and into the line post upon impact as the ramp bears upon the upper edge of the slot.

11. The wire safety barrier as claimed in claim 8 wherein the cable can only exit a cable receiving region when a second threshold is applied, wherein the second threshold force is greater that a first threshold force due to the reduction of width of a constricted exit passage.

12. The wire safety barrier as claimed in claim 8 wherein the cable holder plastically deforms at least in the hook portion as the cable exits the cable receiving region upon impact.

13. The wire rope safety barrier as claimed in claim 1 wherein the cable holder defines an escape pathway to release the cable in a vertically upwards direction.

14. The wire rope safety barrier as claimed in claim 1 wherein the locating notch comprises a substantially vertically extending notch, the locating notch widens towards a lower surface of the cable holder to improve ease of assembly.

15. The wire rope safety barrier as claimed in claim 1 wherein the hook portion of the cable holder comprises a region of weakness configured to allow a segment of the hook portion to deform and release the cable when a lateral force exerted by the cable is greater than a predetermined threshold.

16. The wire rope safety barrier as claimed in claim 1 wherein each line post further comprises a cable slot extending from an upper surface configured to receive one or more internal cables.

17. The wire rope safety barrier as claimed in claim 1 wherein three of the plurality of cables are external cables.

18. The wire rope safety barrier as claimed in claim 17 wherein two of the three external cables engage a first outer surface of the line posts and one of external cables engages a second opposing outer surface of the line posts.

19. The wire rope safety barrier as claimed in claim 1 wherein the cable holder slot has a height less than the height of the body portion of the cable holder.

20. A method of installing a wire rope safety barrier comprising:

installing a plurality of line posts spaced apart along a roadway, each line post comprising a cable holder slot including an upper edge and a lower edge, inserting a cable holder into each cable holder slot, the cable holder having a body portion and a hook portion, and connecting at least one cable to the line posts by positioning the cable into a cable receiving region of cable holders so cables extend between the line posts to define a safety barrier along the roadway, at least one of the at least one cable being an external cable located adjacent an outer surface of the line posts, wherein each external cable engages between the hook portion and the line post, wherein the body portion of the cable holder is elongate and an inner surface of the line post engages with the body portion of the cable holder which is located within the line post to resist lateral movement upon impact, and wherein each cable holder comprises a locating notch at a bottom surface configured to engage with the lower edge of a corresponding cable holder slot.

21. The method of installing a wire rope safety barrier as claimed in claim 20 wherein the cable holder is obliquely inserted into the cable holder slot by first inserting an upper region of the body portion into the cable holder slot.

22. The method of installing a wire rope safety barrier as claimed in claim 21 wherein after the cable holder is inserted into the cable holder slot, a lower locating protrusion at a lower surface of the cable holder engages the lower edge of the cable holder slot to prevent the cable holder from falling inside the line post.

23. The method of installing a wire rope safety barrier as claimed in claim 20 wherein the cable holder is lowered onto the lower edge of the cable holder slot after a tail region of the body portion is inserted within the line post.

24. The method of installing a wire rope safety barrier as claimed in claim 20 wherein the cable holder defines an escape pathway to release the cable in a vertically upwards direction.

25. The method of installing a wire rope safety barrier as claimed in claim 20 wherein a cable enters or exits the cable receiving region once a first threshold force is applied to the cable to move the cable past a constricted exit passage formed by a constricting portion.

26. The method of installing a wire rope safety barrier as claimed in claim 20 wherein an engaging notch at a top surface of the body portion engages with the upper edge of a cable holder slot to resist upward movement of the cable holder as the cable pulls the cable holder upwardly upon impact.

27. The method of installing a wire rope safety barrier as claimed in claim 20 wherein the cable holder rocks backwards into the line post after a locating notch disengages from the cable holder slot as a ramp at a top surface of the body portion guides the cable holder inwards as the cable holder moves upwards.

28. The method of installing a wire rope safety barrier as claimed claim 27 wherein the width of a constricted exit passage reduces as the cable holder is lifted upwardly and into the line post upon impact as the ramp bears upon the upper edge of the cable holder slot.

29. The method of installing a wire rope safety barrier as claimed in claim 28 wherein the cable can only exit a cable receiving region when a second threshold force is applied, wherein the second threshold force is greater than a first threshold force due to a reduction of width of the constricted exit passage.

30. The method of installing a wire rope safety barrier as claimed in claim 20 wherein the cable holder plastically deforms at least in the hook portion as the cable exits the cable receiving region.

31. The method of installing a wire rope safety barrier as claimed in claim 20 wherein a segment of the hook portion deforms at a region of weakness in the cable holder and releases the cable when a lateral force exerted by the cable is greater than a predetermined threshold.

32. The method of installing a wire rope safety barrier as claimed in claim 20 wherein an internal cable is inserted into a cable slot extending from an upper surface of the line post.

* * * * *